United States Patent [19]

Petersen et al.

[11] 3,963,859

[45] June 15, 1976

[54] SUPPORT ASSEMBLY FOR ELECTRIC HEATING UNIT

[75] Inventors: Robert E. Petersen, Grafton; Roger F. Chesebro, Bay Village, both of Ohio

[73] Assignee: Westinghouse Electric Corporation, Pittsburgh, Pa.

[22] Filed: Oct. 28, 1975

[21] Appl. No.: 626,412

[52] U.S. Cl. ..... 174/148; 174/138 J; 219/532; 248/68 R; 338/317

[51] Int. Cl.[2] ..... H05B 3/02

[58] Field of Search ..... 174/138 J, 148, 152 G, 174/153 G; 13/25; 219/355, 532, 536, 537, 542, 546, 548, 551; 338/290, 305, 317, 321; 248/68 R

[56] References Cited

UNITED STATES PATENTS

| | | | |
|---|---|---|---|
| 1,307,198 | 6/1919 | Harth | 338/290 UX |
| 1,493,386 | 5/1924 | Rice | 219/532 |
| 1,628,876 | 5/1927 | Ehrgott | 338/317 |
| 1,751,797 | 3/1930 | Dibble | 219/532 |
| 3,812,322 | 5/1974 | Osterkorn et al. | 219/532 |
| 3,920,887 | 11/1975 | Kloos et al. | 174/148 |

*Primary Examiner*—Laramie E. Askin
*Attorney, Agent, or Firm*—E. C. Arenz

[57] ABSTRACT

A support strip for insulating bushings has spaced cutouts therein to receive the bushings. A locking bar which closes the open side of the cutouts to hold the bushings in place is arranged so that it interengages with the web portions between the cutouts by being received on first one side and then the other side of successive webs.

5 Claims, 7 Drawing Figures

SUPPORT ASSEMBLY FOR ELECTRIC HEATING UNIT

CROSS REFERENCE TO RELATED APPLICATION

Dietsche and Petersen, U.S. patent application Ser. No. 626,413, filed Oct. 28, 1975 is a related application in that it also discloses a support member arrangement in which two strips are in interengaging relation to hold the insulating bushings in place.

BACKGROUND OF THE INVENTION

1. Field of the Invention

The invention pertains to the art of electric heating units and in particular to support means for carrying insulating bushings which support open-coil electrical resistance heating elements.

2. Description of the Prior Art

Prior art patents which teach support members for carrying insulating bushings and supporting open-coil elements for electric heating units of the same type with which this invention is concerned are the following: U.S. Nos. 3,812,322; 1,751,797 and 1,628,876. In the arrangement of the first two listed patents, after the strips with cutouts are placed in their final assembled position, an additional step is required to secure the two strips in their assembled relation. Also in the second listed patent, the fastening arrangement is of the type which does not permit ready disassembly of the two strips for the replacement of an insulating bushing.

The present invention has among its aims the provision of an improved, inexpensive construction in which the assembly may be accomplished quickly and easily, and also in which intentional disengagement of the assembly may be done easily.

SUMMARY OF THE INVENTION

In accordance with the invention, a strip with a number of spaced-apart, open-sided cutouts having intervening webs receives the insulating bushings in the cutouts, and a locking bar closes the open side of the cutouts by interengaging with alternating sides of successive webs. In the currently preferred form, successive ones of the webs have their distal end portions alternately displaced one way and another way to provide a clearance space for a locking bar which is generally planar in form and is received in the clearance space.

DRAWING DESCRIPTION

DESCRIPTION OF THE PREFERRED EMBODIMENTS

Figure 1:
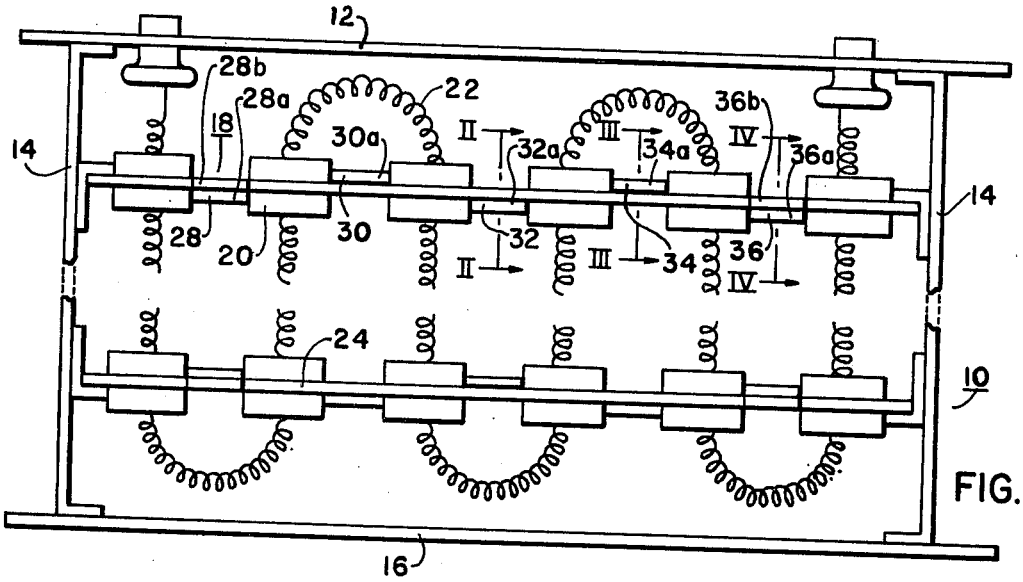
FIG. 1 is a plan view of a part of an electric heating unit having support assemblies according to the invention.
Figure 2:
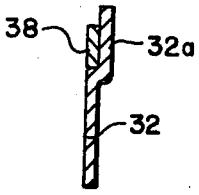
FIGS. 2, 3 and 4 are enlarged sectional views, corresponding to ones taken along the lines II—II, III—III, IV—IV, respectively, of FIG. 1.
Figure 3:
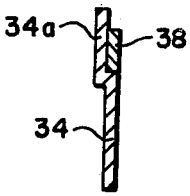
Figure 4:
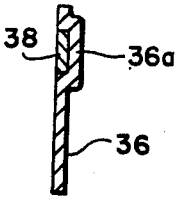
Figure 5:
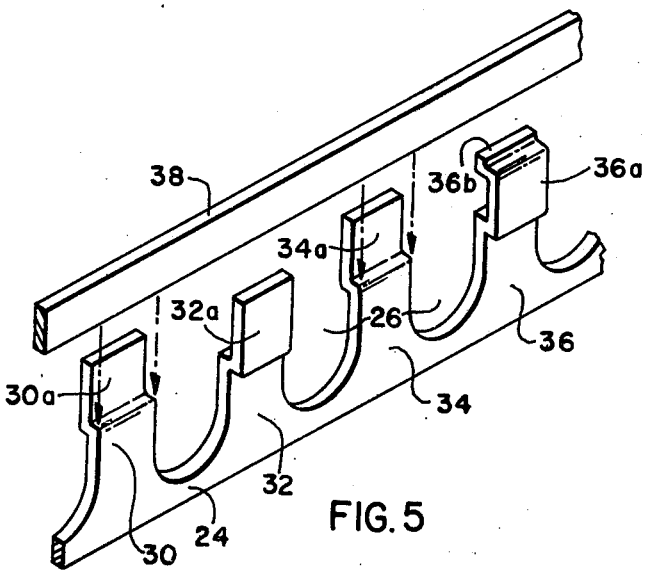
FIG. 5 is an exploded fragmentary isometric view of a strip and a planar locking bar.
Figure 6:
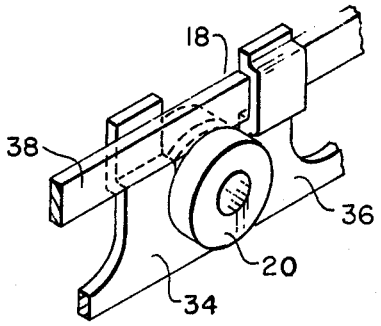
FIG. 6 is a fragmentary isometric view illustrating the locking bar in place capturing an insulating bushing.

Referring to FIG. 1, the electric heating unit 10 has the general form of an open-face perimetric frame formed of a base wall 12, side walls 14 and end wall 16. A plurality of support members generally designated 18 extend between the opposite side walls and carry ceramic insulating bushings 20 through which the open-coil electrical resistance heating element 22 is threaded. A strip 24 which forms a part of the support assembly is shown in FIG. 1 and is also shown in the isometric view of FIG. 5. As seen in these views, the strip includes a number of spaced-apart, open-sided cutouts 26 with intervening webs between the cutouts, the webs being numbered from left to right in FIG. 1 as 28, 30, 32, 34, and 36. Successive ones of these webs have their distal end portions designated *a* displaced one way and another out of the plane of the webs to provide a clearance space to receive a locking bar 38. Thus, the center web 32 has its distal end portion 32*a* displaced into a plane toward the viewer in FIG. 5, while the adjacent webs 30 and 34 have their distal end portions 30*a* and 34*a*, respectively, displaced into a plane away from the viewer in FIG. 5. As viewed from above then, it will be apparent that a clearance space to accommodate the thickness of the locking rod 38 is provided. However, at least two of the distal end portions include end margin portions 28*b* and 36*b* (those webs near the ends of the strip) which are displaced back to overlie the plane of the major portion of the web. To hold the bar against disengagement upwardly from the cutouts after the bar has been moved into the clearance space, the shape of these distal end portions is somewhat like a shallow hook, as shown in FIG. 4. The relationship of two adjacent webs with the bushing in place and the locking bar in place is best seen in FIG. 6.

Figure 7:
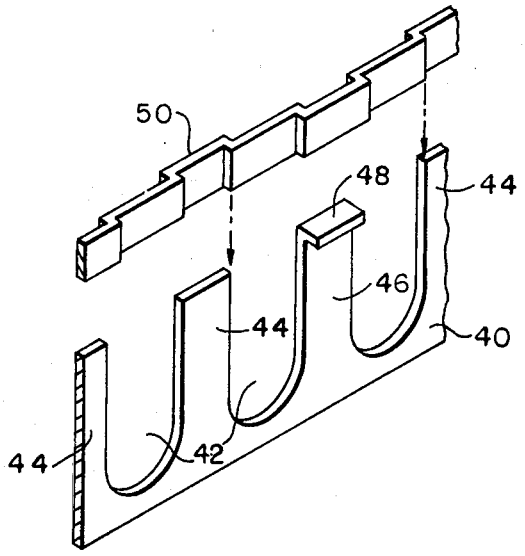
FIG. 7 is an exploded, fragmentary isometric view of another form of the invention.

Another form of the invention is seen in FIG. 7 in which the strip 40 having cutouts 42 has the intervening webs 44 in the same plane as the strip, except for at least two of the webs 46 which have an end margin portion 48 bent over to form a locking flange. The locking bar 50 includes portions of its length alternately displaced one way and another to fit with the strip. In other words, one portion of the length of the locking bar will be on one side of a web 44 while another length of the locking bar will be on the opposite side of the next web 44. The strips are of relatively lightweight sheet metal such as 18 gauge and accordingly the web 46 will yield sufficiently to the side to permit the assembly of the locking bar to the strip and will then spring back so that the flange portion 48 overlies the top edge of the locking bar.

The arrangement permits the assembly of the parts to make up the electric heating unit 10 as follows. The strips 24 are fastened at their ends to the side walls 14 with the cutouts being upwardly open. The coil 22 with the required number of bushings 20 strung thereon is then placed in position with one bushing seated in each cutout. The locking bar 38, or 50, as the case may be, is then pushed down in place into the clearance space with the web 37 of FIG. 5 being sprung out of the way, and in the case of the FIG. 7 arrangement with the web 46 being sprung out of place. In either case, the assembly may be readily accomplished without the use of any tools or any requirement for fastening the locking bar.

It will also be appreciated that if any bushings are to be replaced, the locking bars may be readily disassembled from the strips.

What is claimed is:

1. A support member carrying insulating bushings for supporting an open coil electrical heating element, comprising:

a strip having a number of spaced-apart, open-sided cutouts with intervening webs;

an insulating bushing in each said cutout, said bushings each having a circumferential groove seating in the cutout to hold said bushing against transverse disengagement from the strip;

a locking bar closing the open sides of said cutouts to hold said bushings against upward disengagement from said cutouts, said locking bar lying on alternating sides of successive webs along the length of the strip; and at least two of said webs including end margin portions displaced to overlie the top edge of said bar at those web locations to hold said bar against disengagement upwardly away from the cutouts.

2. A support member according to claim 1 wherein:

successive ones of said webs have distal end portions alternately displaced one way and another way to provide a clearance space for said locking bar; and said locking bar is generally planar and received in said clearance space.

3. A support member according to claim 2 wherein:

said distal end portions are generally planar save for those webs having said end margin portions displaced, said end margin portions generally lying in the plane of the major part of said webs.

4. A support member according to claim 1 wherein:

said webs lie in a common plane except for said displaced end margin portions; and said locking bar includes portions of its length alternately displaced one way and another way to register with said alternating sides of said successive webs.

5. A support member carrying insulating bushings for supporting an open coil electrical heating element, comprising:

a strip having a number of spaced-apart, open-sided cutouts with intervening webs, alternating ones of said webs having distal end portions displaced out of the plane of said webs one way and the opposite way to provide a clearance space in the general plane of said webs to receive a locking bar;

an insulating bushing in each of said cutouts, said bushings having circumferential grooves seating in the cutouts;

a locking bar received in said clearance space to close the open sides of said cutouts; and at least two of the web distal end portions including end margin portions displaced back to overlie the clearance space to hold said bar in said clearance space.

* * * * *